US006076305A

United States Patent [19]

Hsu

[11] Patent Number: 6,076,305

[45] Date of Patent: Jun. 20, 2000

[54] STRUCTURE FOR FIXING A BLIND ON A WINDOW OR DOOR FRAME

[76] Inventor: Peyson Hsu, No. 373, Sec. 4, Yen-Hai Rd., Fu-Nan Tsun, Fu Hsing Hsiang, Changhua Hsien, Taiwan

[21] Appl. No.: 09/285,645

[22] Filed: Apr. 5, 1999

[51] Int. Cl.[7] ..... E06B 1/04

[52] U.S. Cl. ..... 49/505; 52/217

[58] Field of Search ..... 49/504, 505; 52/217; 403/408.1, 409.1, 374.1, 374.2, 374.3, 374.4, 365

[56] References Cited

U.S. PATENT DOCUMENTS

| | | | |
|---|---|---|---|
| 2,651,814 | 9/1953 | Lester | 49/505 |
| 3,974,621 | 8/1976 | Stang | 403/409.1 |
| 4,713,922 | 12/1987 | Ingold | 49/505 X |
| 5,167,073 | 12/1992 | Stein | 52/217 X |
| 5,417,518 | 5/1995 | Bierwith | 403/374.2 |
| 5,561,955 | 10/1996 | Frobosilo et al. | 52/217 |

*Primary Examiner*—Jerry Redman

*Attorney, Agent, or Firm*—Doutherty & Troxell

[57] ABSTRACT

A structure for fixing a blind on a window or door frame, including two blind main bodies, four hinges, two connecting boards, two sets of decorative plates and four sets of auxiliary blocks. Each auxiliary block is a right triangular body formed with a longitudinal slot at a middle section. The slope face of the auxiliary block is disposed with a continuous stepped face. In the case that the middle gap between the two blind main bodies is too large after fitted with inner sides of the window or door frame, the auxiliary blocks can be reversely engaged and by means of moving the two contacting stepped faces, the engaged auxiliary blocks can be adjusted to have a certain width and then locked between the connecting boards and the inner sides of the window or door frame so that the gap between the two blind main bodies can be easily and quickly rectified to a suitable size. In addition, in the case that the inner sides of the window or door frame are formed with deflected faces due to poor working, by means of attaching the auxiliary block onto the deflected faces, the deflection can be rectified to enable the blind main bodies to be straightly assembled with the window or door frame.

1 Claim, 5 Drawing Sheets

STRUCTURE FOR FIXING A BLIND ON A WINDOW OR DOOR FRAME

BACKGROUND OF THE INVENTION

The present invention relates to a structure for fixing a blind on a window or door frame. In the case that the middle gap between the two blind main bodies is too large after fitted with inner sides of the window or door frame or in the case that the inner sides of the window or door frame are formed with deflected faces due to poor working, the structure is able to easily and quickly rectify the gap or deflection and enable the blind main bodies to be straightly assembled with the window or door frame.

FIG. 1 shows a conventional blind including two blind main bodies 10, four hinges 20, two connecting boards 30,two sets of decorative plates 40 and two sets of pad strips 50. When installing the two blind main bodies 10 on a window or a door frame A (also referring to FIG. 2), each of the upper and lower ends of one side of the blind main body 10 is locked with a pivot face 21 of the hinge 20. The other pivot face 22 of the hinge 20 is locked with each of the upper and lower ends of one side of the connecting board 30. Then the connecting boards 30 together with the blind main bodies 10 are vertically or horizontally fitted with two inner sides of the window or door frame A.

After the two blind main bodies 10 are fitted into the window or door frame A, in the case that the middle gap between the two blind main bodies 10 is too large, multiple layers of pad strips 50 can be adhered to the other side of the connecting board 30 to reduce the middle gap between the two blind main bodies 10 to a suitable size (also referring to FIG. 3 which is an enlarged view of a part of FIG. 2). Therefore, the two blind main bodies 10 can be smoothly opened and closed. Then the connecting boards 30 with the multiple layers of pad strips 50 are locked on the inner sides of the window or door frame A. Finally, the decorative plates 40 are attached to the adjoining portions of the connecting boards 30 and the window or door frame A to achieve a better appearance and complete the assembly.

Some shortcomings exist in the above arrangements as follows:

1. In order to rectify the too large middle gap between the two blind main bodies 10 after fitted with the inner sides of the window or door frame A, multiple layers of pad strips 50 need to be adhered to the connecting boards 30. Such procedure is troublesome and time-consuming.
2. In the case that the two inner sides of the window or door frame A are deflected due to poor working, it will be impossible to straightly fix the connecting boards 30 on two inner sides of the window or door frame A. Under such circumstance, the deflection cannot be rectified by the pad strips 50 and the quality of the blind will be poor.

SUMMARY OF THE INVENTION

It is therefore a primary object of the present invention to provide an improved structure for fixing a blind on a window or door frame. In the case that the middle gap between the two blind main bodies is too large after fitted with inner sides of the window or door frame, by means of adjusting the auxiliary blocks to have a certain width and then locking the auxiliary blocks between the upper and lower ends of the connecting boards and the inner sides of the window or door frame, the gap can be easily and quickly reduced and rectified to a suitable size.

It is a further object of the present invention to provide the above structure in which in the case that the inner sides of the window or door frame are formed with deflected faces due to poor working, an auxiliary block can be attached to the deflected face to rectify the same into a straight face, enabling the blind main bodies to be straightly assembled with the window or door frame so as to achieve a good quality of assembly.

The present invention can be best understood through the following description and accompanying drawings wherein:

DETAILED DESCRIPTION OF THE PREFERRED EMBODIMENT

Figure 1:
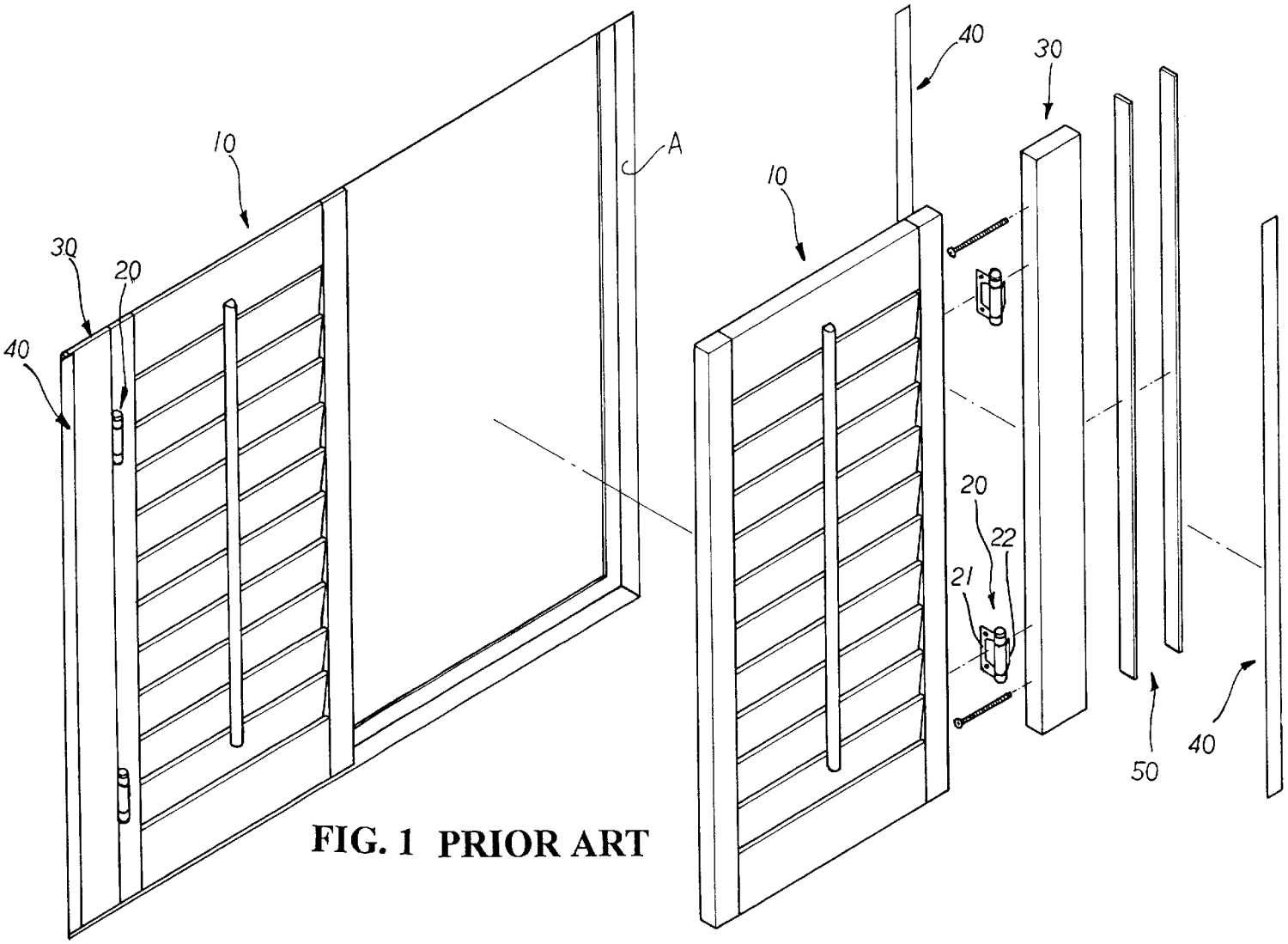
FIG. 1 PRIOR ART
FIG. 1 a perspective exploded view of a conventional fixing structure for a blind.
Figure 2:
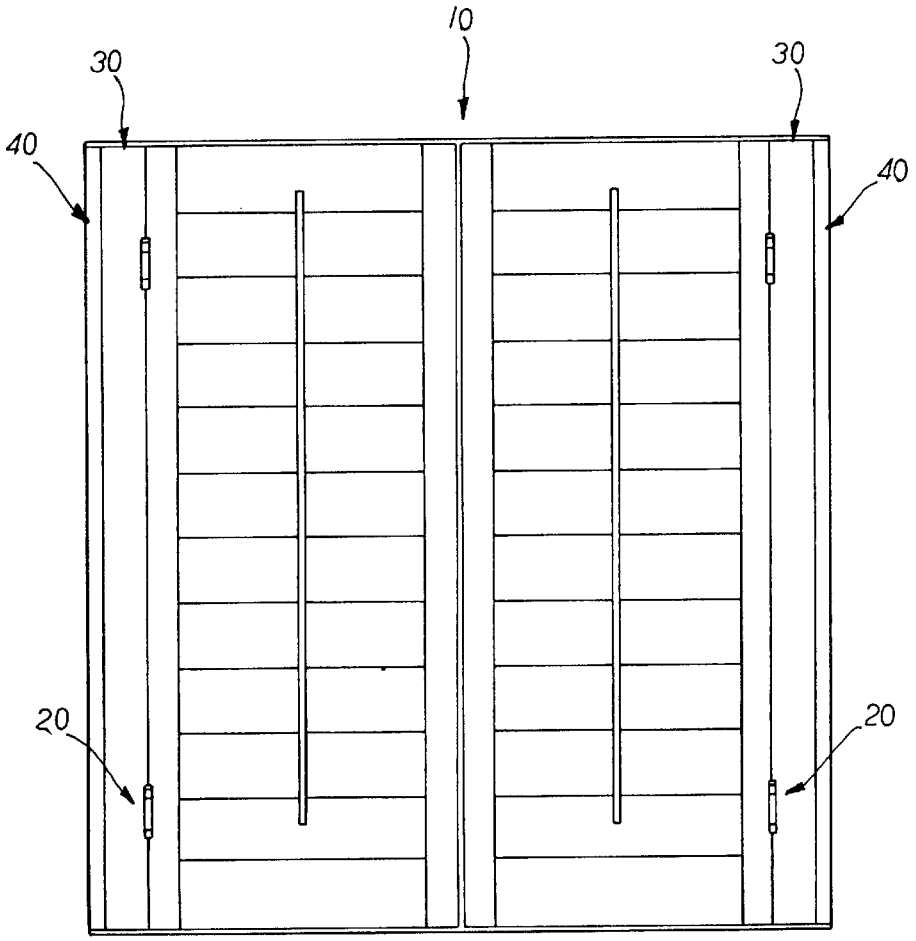
FIG. 2 PRIOR ART
FIG. 2 is a front assembled view of the conventional fixing structure for the blind.
Figure 3:
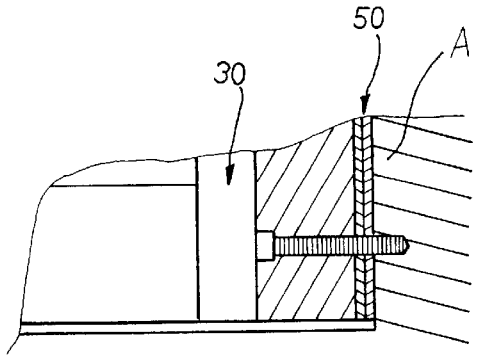
FIG. 3 PRIOR ART
FIG. 3 is an enlarged sectional view of a part of FIG. 2.
Figure 4:
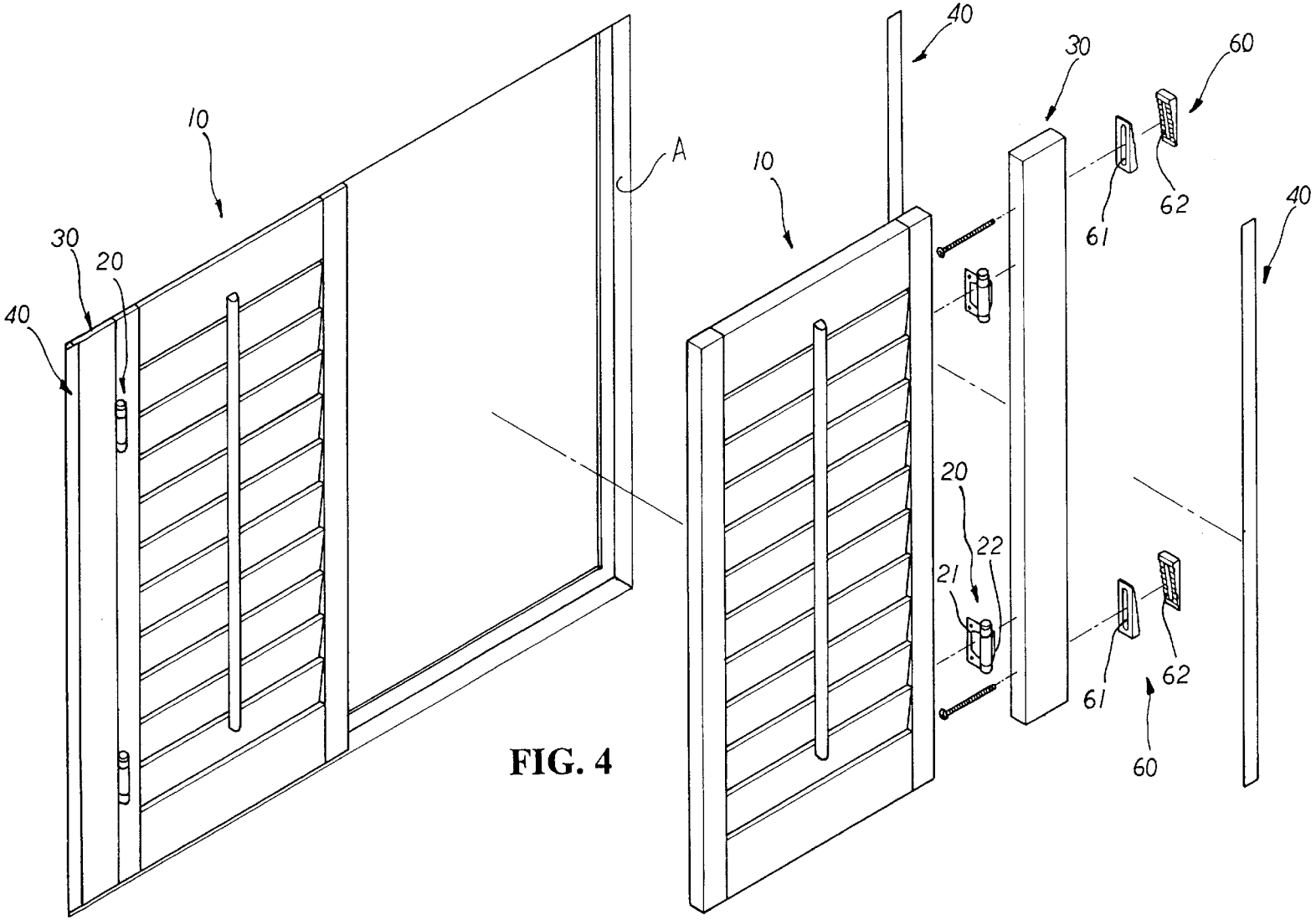
FIG. 4 is a perspective exploded view of the present invention.
Figure 5:
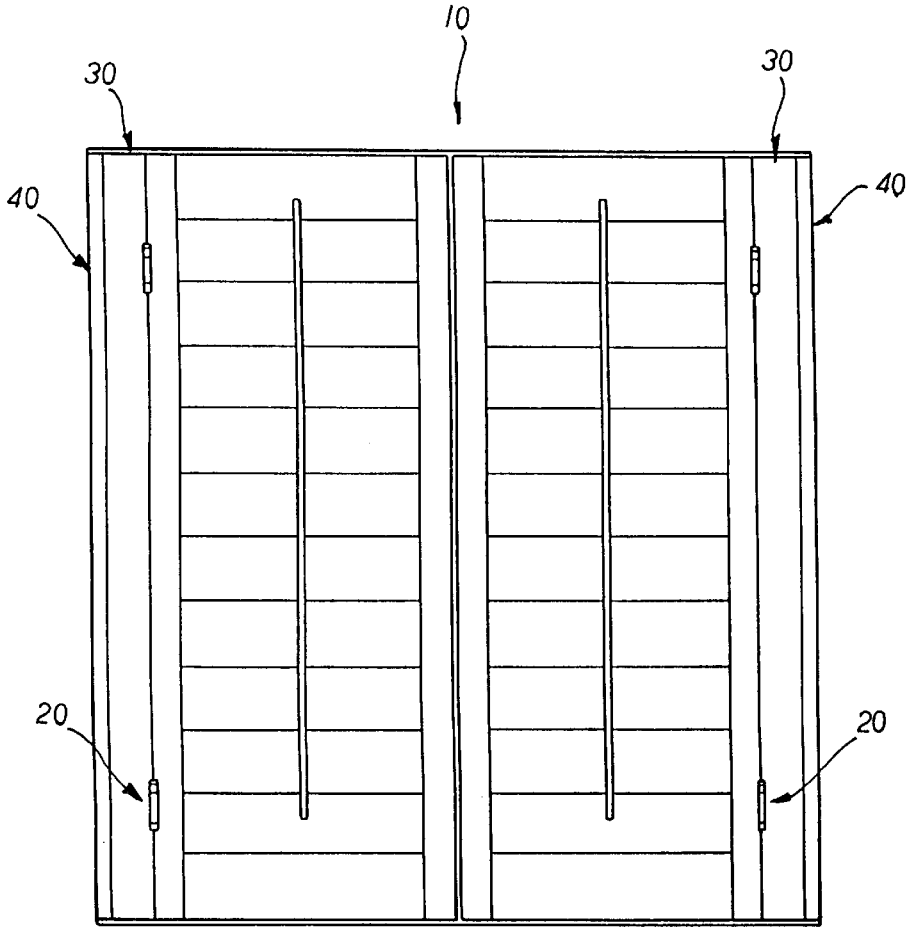
FIG. 5 is a front assembled view of the present invention.

Please refer to FIG. 4. The present invention includes two blind main bodies 10, four hinges 20, two connecting boards 30, two sets of decorative plates 40 and four sets of auxiliary blocks 60. Each auxiliary block 60 is a right triangular body formed with a longitudinal slot 61 at middle section. The slope face of the auxiliary block 60 is disposed with a continuous stepped face 62. The slope stepped faces 62 of two auxiliary blocks 60 can be adjustably engaged with each other as necessary. When assembling the two blind main bodies 10 with the window or door frame A (also referring to FIG. 5 showing the assembly of the present invention), each of the upper and lower ends of one side of the blind main body 10 is locked with a pivot face 21 of the hinge 20. The other pivot face 22 of the hinge 20 is locked with each of the upper and lower ends of one side of the connecting board 30. Then the connecting boards 30 together with the blind main bodies 10 are vertically or horizontally fitted with two inner sides of the window or door frame A.

Figure 6A:
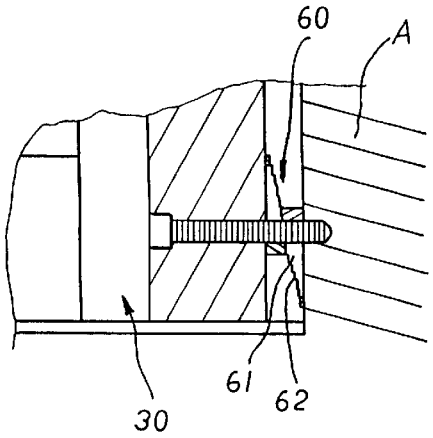
FIGS. 6A and 6B are sectional views of the auxiliary block of the present invention, showing the adjustment thereof.
Figure 6B:
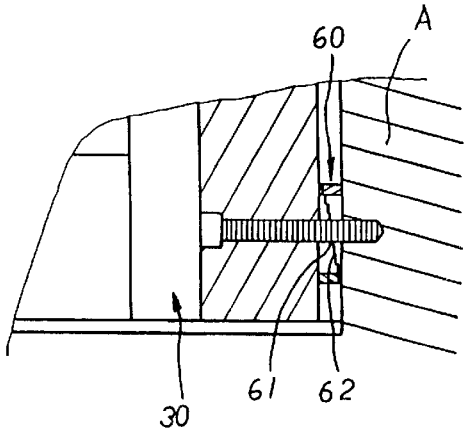

After the two blind main bodies 10 are fitted into the window or door frame A, in the case that the middle gap between the two blind main bodies 10 is too large, the four sets of auxiliary blocks 60 are reversely engaged. By means of moving the two contacting stepped faces 62 within the range of the slot 61, the width of the engaged auxiliary blocks 60 can be adjusted to a certain size (also referring to FIGS. 6A and 6B showing sectional views of the adjustment of the auxiliary blocks). Then the auxiliary blocks 60 are placed between the upper and lower ends of the window or door frame A and the connecting board 30 and then a bolt is passed through the connecting board 30 and the slots 61 of the auxiliary blocks 60 to lock with the inner side of the window or door frame A. Accordingly, the middle gap between the two blind main bodies 10 can be adjusted to a suitable size for smoothly opening and closing the blind main bodies 10. Then the decorative plates 40 are attached to the adjoining portions of the connecting boards 30 and the window or door frame A to achieve a better appearance and complete the assembly.

Figure 7:
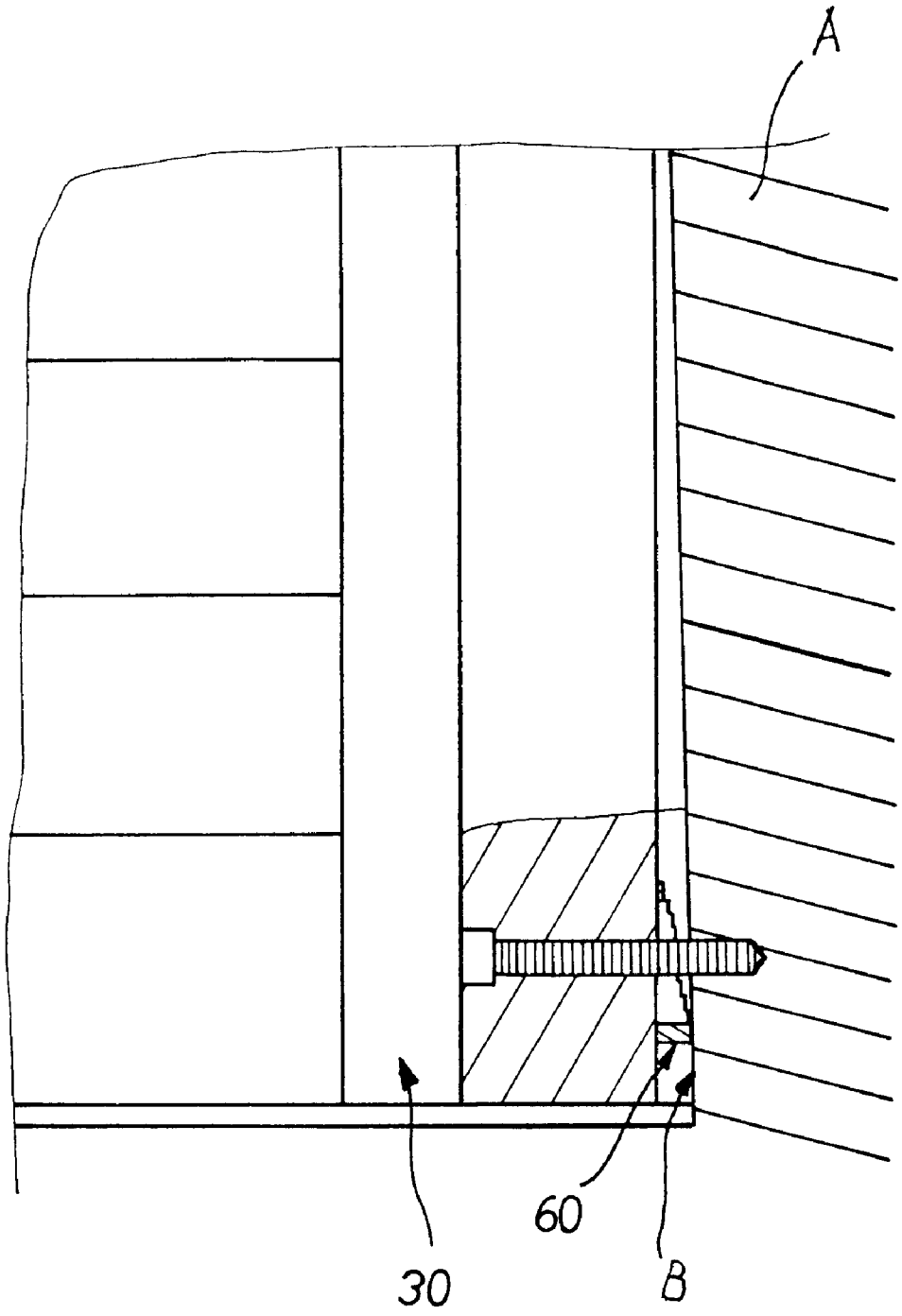
FIG. 7 is a sectional assembled view of the present invention and the deflected inner side of the window or door frame.

FIG. 7 is a sectional view showing the application of the present invention to a deflected window or door frame. In the case that the inner sides of the window or door frame A are formed with deflected faces B due to poor working, an auxiliary block 60 is attached to the deflected face B to rectify the inclination, whereby the connecting board 30 on one side of the blind main body 10 can be straightly fixed on the inner side of the window or door frame A.

According to the above arrangements, the present invention has the following advantages:

1. In the case that the middle gap between the two blind main bodies 10 is too large after fitted with the inner sides of the window or door frame A, by means of cooperation and adjustment of the auxiliary blocks 60, the gap can be rectified to a suitable size. Such procedure can be easily and quickly performed.
2. In the case that the two inner sides of the window or door frame A are formed with deflected faces B due to poor working, by means of the auxiliary block 60, the deflection can be rectified, enabling the connecting board 30 to be straightly fixed on two inner sides of the window or door frame A. Under such circumstance, the two blind main bodies 10 can be straightly assembled with the window or door frame A to achieve a good quality of assembly.

The above embodiment is only used to illustrate the present invention, not intended to limit the scope thereof. Many modifications of the above embodiment can be made without departing from the spirit of the present invention. rectified, enabling the connecting board to be straightly fixed on two inner sides of the window or door frame to achieve a good quality of assembly.

What is claimed is:

1. A structure for attaching a blind to a frame, comprising: two main blind bodies; four hinges; two connecting boards; and four sets of auxiliary blocks, each set having two auxiliary blocks wherein: two of the four hinges are respectively attached to upper and lower ends of each of the two main blind bodies and the two connecting boards;

each auxiliary block comprising a right triangular body having a longitudinal slot through a middle section, and a sloped face having a plurality of steps such that the sloped face of each set of auxiliary blocks are engaged to adjust a width of each set and two sets of the four sets of auxiliary blocks are located between upper and lower ends of each of the connecting boards and inner sides of the frame, whereby a gap between the two main blind bodies can be easily and quickly adjusted to a desired size.

* * * * *